US010661131B2

(12) United States Patent
Harrington et al.

(10) Patent No.: US 10,661,131 B2
(45) **Date of Patent: *May 26, 2020**

(54) GOLF CLUB HEAD WITH IMPROVED SOLE

(71) Applicant: Acushnet Company, Fairhaven, MA (US)

(72) Inventors: James P. Harrington, Del Mar, CA (US); Oswaldo Gonzalez, San Jacinto, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/180,968

(22) Filed: Nov. 5, 2018

(65) Prior Publication Data

US 2019/0070468 A1 Mar. 7, 2019

Related U.S. Application Data

(63) Continuation of application No. 15/469,939, filed on Mar. 27, 2017, now Pat. No. 10,143,900.

(51) Int. Cl.
*A63B 53/04* (2015.01)

(52) U.S. Cl.
CPC .... *A63B 53/047* (2013.01); *A63B 2053/0408* (2013.01); *A63B 2053/0433* (2013.01); *A63B 2053/0479* (2013.01)

(58) Field of Classification Search
CPC ..... A63B 53/047; A63B 2053/0433; A63B 2053/0408; A63B 2053/0479
USPC ..... 473/324–350, 287–292
See application file for complete search history.

(56) References Cited

U.S. PATENT DOCUMENTS

| | | | | |
|---|---|---|---|---|
| 645,944 | A | 3/1900 | Dalgleigh | |
| 4,671,513 | A | 6/1987 | Swanson | |
| 5,301,944 | A | 4/1994 | Koehler | |
| 5,326,105 | A | 7/1994 | Fenton, Jr. | |
| 5,398,935 | A | 3/1995 | Katayama | |
| 5,482,280 | A | 1/1996 | Yamawaki | |
| 5,549,296 | A | 8/1996 | Gilbert | |
| 6,325,728 | B1 * | 12/2001 | Helmstetter | A63B 53/04 473/328 |
| 6,464,598 | B1 | 10/2002 | Miller | |
| 6,471,601 | B1 | 10/2002 | McCabe | |
| 7,371,189 | B2 | 5/2008 | Yamamoto | |
| 7,393,286 | B1 | 7/2008 | Renegar | |
| 7,517,286 | B2 | 4/2009 | Nagai | |

(Continued)

OTHER PUBLICATIONS

Cleveland 588 Tour Action Wedges golfreview.com [online] [retrived on Jun. 18, 2018] Retrieved from Internet: <URL: http://www.golfreview.com/product/golf-clubs/wedges/cleveland/588-tour-action.html>.

(Continued)

*Primary Examiner* — Sebastiano Passaniti
(74) *Attorney, Agent, or Firm* — Richard J. Albright

(57) ABSTRACT

A golf club head with an improved sole profile is disclosed herein. More specifically, the present invention discloses a wedge type golf club head wherein the sole is formed from continuously variable radius of curvature from the leading edge to the trailing edge, without any identifiable inflection points. The resulting golf club head improves performance, as this new sole profile allows specific portions of the sole to have a profile that meets the needs at that location.

12 Claims, 8 Drawing Sheets

(56) References Cited

U.S. PATENT DOCUMENTS

| | | | | |
|---|---|---|---|---|
| 7,614,962 | B1 | 11/2009 | Clausen | |
| 8,083,607 | B2 | 12/2011 | Clausen | |
| 8,734,270 | B2 | 5/2014 | Harrington | |
| 9,421,435 | B2 | 8/2016 | Jertson | |
| 10,143,900 | B2 * | 12/2018 | Harrington | A63B 53/047 |
| 2004/0157679 | A1 * | 8/2004 | Poincenot | A63B 53/047<br>473/324 |
| 2012/0108356 | A1 * | 5/2012 | Harrington | A63B 53/04<br>473/328 |

OTHER PUBLICATIONS

TaylorMade RAC Black TP Wedge Review Equipment Reviews Today's Golfer [online] [retrived on Jun. 18, 2018] Retrieved from Internet: <URL: https://www.todaysgolfer.co.uk/equipment/golf-clubs/wedges/taylormade/rac/taylormade-rac-black-tp/>.

Tour Striker Swing Trainer Training Aide 56 Degree Wedge MRH Steel RockBottomGolf.com [online] [retrived on Jun. 18, 2018] Retrieved from Internet: <URL: https://www.rockbottomgolf.com/accessories/training-aids/swing-trainers/new-tour-striker-golf-swing-trainer-training-aid-56-wedge-mrh-steel/>.

* cited by examiner

GOLF CLUB HEAD WITH IMPROVED SOLE

CROSS-REFERENCE TO RELATED APPLICATION

The present application is a Continuation of U.S. patent application Ser. No. 15/469,939, filed Mar. 27, 2017, the disclosure of which is incorporated by reference in its entirety.

FIELD OF THE INVENTION

The present invention relates to a golf club head having an improved sole profile. More specifically, the present invention relates to an iron type golf club head with an improved sole profile, as the iron type golf club head of this type often has significant sole contact, and can benefit from improvements in the sole profile. The sole profile becomes more important in wedge type golf club heads used for shorter shots, as not only do they need to engage the sole in full swing shots, but must also be versatile enough to perform in various different types of wedge shots.

BACKGROUND OF THE INVENTION

Iron type golf clubs are generally used by golfers to hit golf shots from the turf, which means they are designed to hit golf shots that lay directly on the grass itself. Given that the sole of these types of golf club heads are the part of the golf club head that has the most surface area to contact the turf, the design of the sole profile often has a significant impact on the quality of the turf interaction.

U.S. Pat. No. 945,944 to Dalgleish illustrates one of the earlier attempts at improving the performance of the golf club by changing the sole profile. Despite the fact that the invention by Dalgleish was directed more of a "brassies" type wood or fiber golf club head, it illustrated an early recognition of the importance of sole interaction with a golf club and a design intended to improve the performance.

In a more modern context, U.S. Pat. No. 4,671,513 to Swanson illustrates "a golf club iron provided with protuberances or knobs on the bottom sole face thereof to minimize 'fat' shots, reduce the size of the divots, and to accommodate tilting of the club head on the turf laterally and in front to rear directions without spoiling the shot."

U.S. Pat. No. 7,393,286 to Renegar provides an alternative way to adjust the sole of a golf club by providing contours to help the interaction between the golf club and the turf it often comes in contact with.

Finally, U.S. Pat. No. 6,471,601 to McCabe et al. provides another illustration wherein the sole of the golf club head is improved for better performance, this time utilizing a crescent surface, a positive bounce surface, a heel surface, and a toe surface.

The present invention improves upon the previously mentioned designs by creating a golf club head wherein the sole contours are carefully designed to improve the performance of the golf club head not only improving full shots; as shown by all the previous examples, but also improving other types of shots. More specifically, the present invention recognizes that a wedge type golf club head may be used to execute a multitude of different golf shots, including but not limited to full shots, flop shots, knock down shots; all of which engage different portions of the sole contour.

BRIEF SUMMARY OF THE INVENTION

One aspect of the present invention is a golf club head comprising of a striking face located at a frontal portion the golf club head, a topline located at an upper portion of the golf club head, a heel portion located at a proximal end of the golf club head, adapted to receive a shaft, a toe portion located at a distal end of the golf club head opposite the heel end, and a sole located at a lower portion of the golf club head opposite the topline. The sole further comprises of a leading edge point and a sole trailing contact point, wherein the sole further comprises of two or more convex radii that are different from each other, and wherein the sole has a sole entry height of between about 2.0 mm and about 8.0 mm, the sole entry height is defined as a difference between a height of the sole at the leading edge point and a height of the sole at a distance of 1.2 mm back from the leading edge point.

Another aspect of the present invention is a golf club head comprising of a striking face located at a frontal portion the golf club head, a topline located at an upper portion of the golf club head, a heel portion located at a proximal end of the golf club head, adapted to receive a shaft, a toe portion located at a distal end of the golf club head opposite the heel end, and a sole located at a lower portion of the golf club head opposite the topline. The sole further comprises of a leading edge point and a sole trailing contact point, wherein said sole further comprises two or more convex radii that are different from each other, and wherein the sole has a sole entry angle of greater than about 60°; the sole entry angle defined as an angle created by a line connecting the leading edge point and a height of the sole at a distance 1.2 mm back from the leading edge point, relative to a horizontal plane.

A further aspect of the present invention is a golf club head comprising of a striking face located at a frontal portion the golf club head, a topline located at an upper portion of the golf club head, a heel portion located at a proximal end of the golf club head, adapted to receive a shaft, a toe portion located at a distal end of the golf club head opposite the heel end, and a sole located at a lower portion of the golf club head opposite the topline. The sole further comprises of a leading edge point and a sole trailing contact point, wherein said sole further comprises two or more convex radii that are different from each other, and wherein the golf club head has a "Sole Contour Ratio" of less than about 0.25, the "Sole Contour Ratio" is defined as a leading edge sole radius divided by a trailing edge sole radius.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
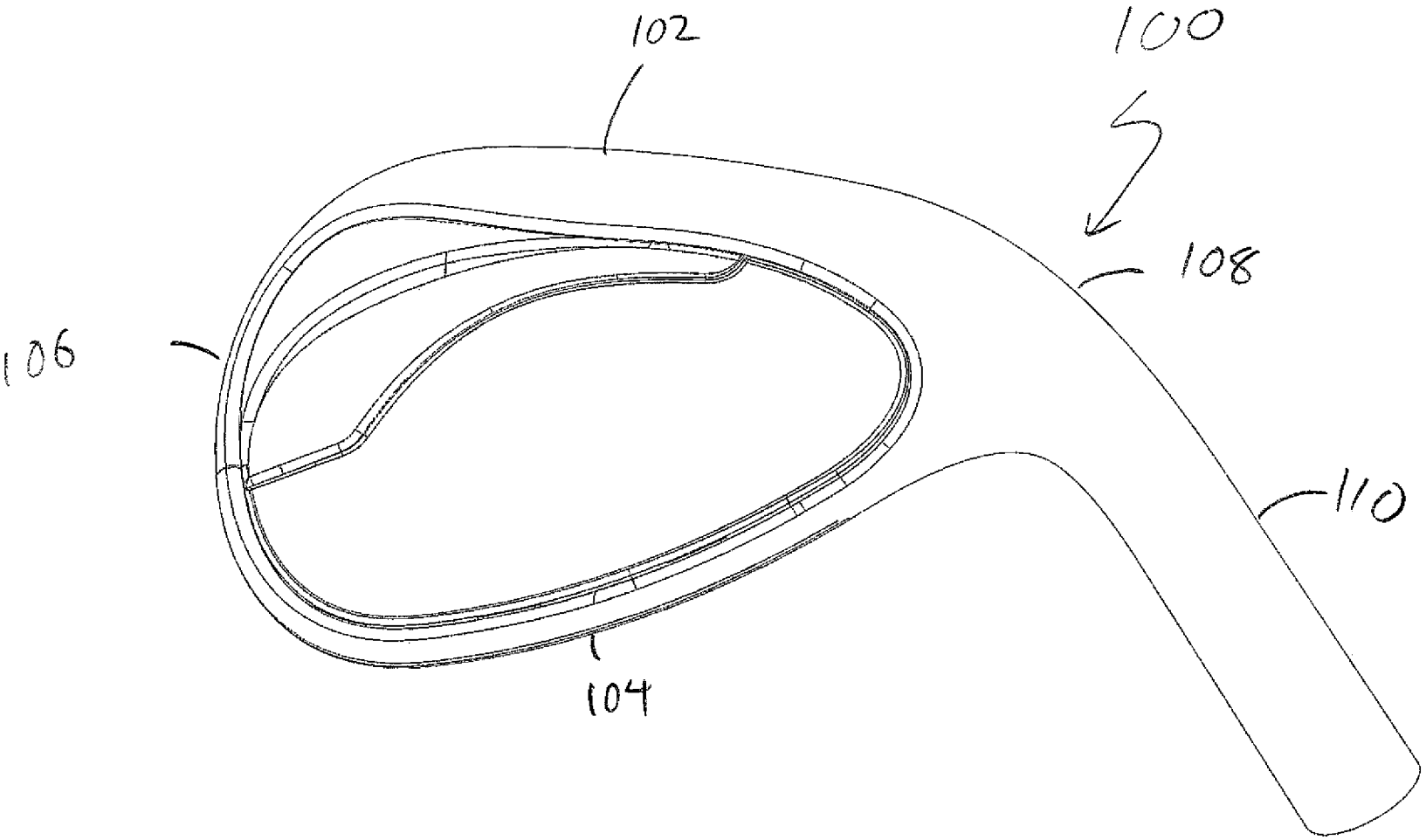
FIG. 1 of the accompanying drawings shows a perspective view of a golf club head in accordance with an exemplary embodiment of the present invention.

FIG. 1 of the accompanying drawings shows a perspective view of a golf club head 100 in accordance with an exemplary embodiment of the present invention. The golf club head 100 shown in FIG. 1 may generally have a sole 102, a topline 104, a toe portion 106, a heel portion 108, and a hosel 110. Although not visually discernable from this perspective view, the golf club head 100 shown in FIG. 1 incorporates a new and innovative sole profile that dramatically improves the performance of the golf club head 100. The innovative sole 102 contains a continuously variable radius of curvature from the leading edge to the trailing edge of the sole 102 without any identifiable inflection points. This continuously variable radius allows for a more exact adjustment of the specific sole 102 to accommodate the specific needs of the sole 102 at various different points to help improve the performance of the golf club head 100.

Figure 2:
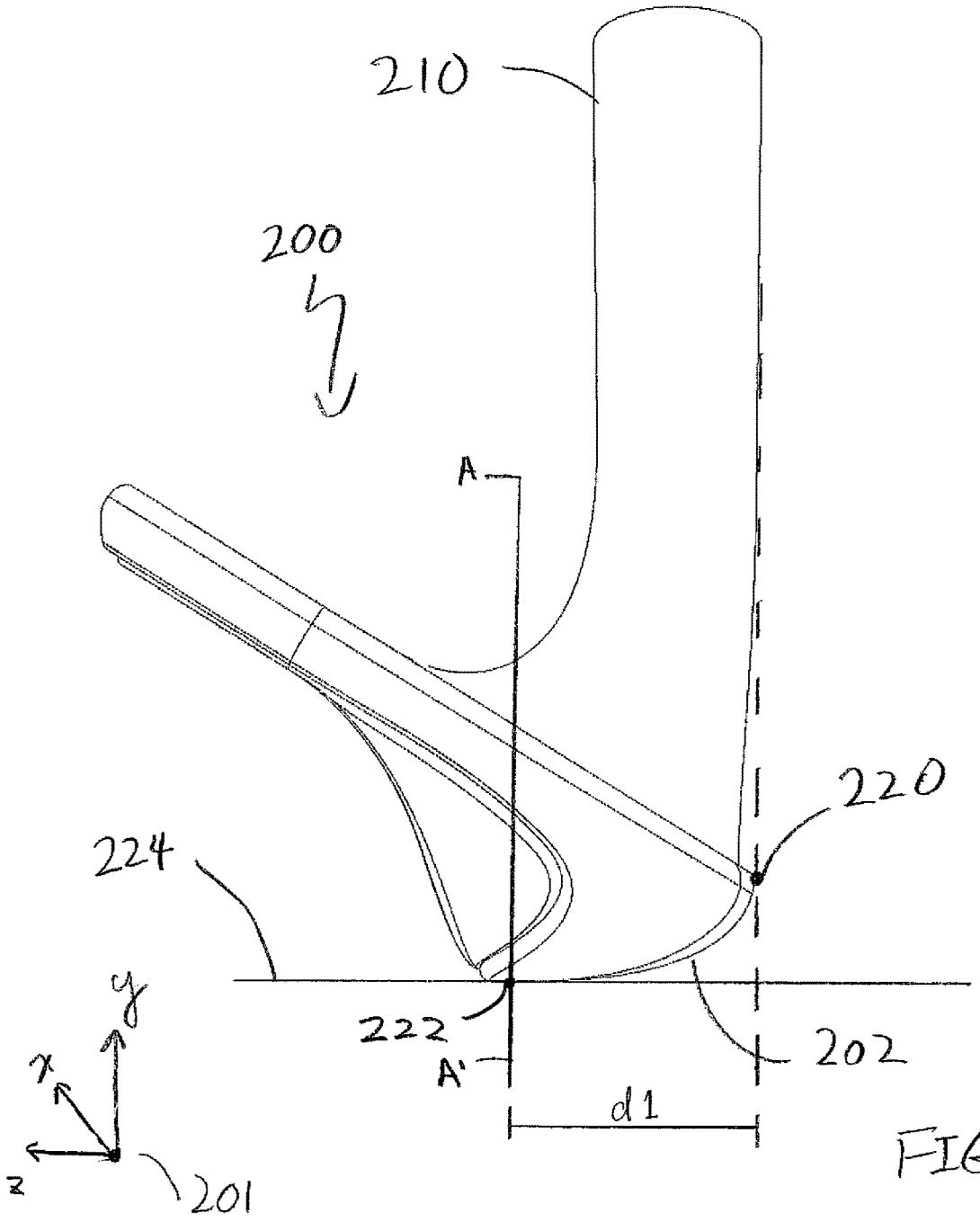
FIG. 2 of the accompanying drawings shows a side view of a golf club head in accordance with an exemplary embodiment of the present invention.

FIG. 2 of the accompanying drawings shows a toe side view of a golf club head 200 in accordance with an exemplary embodiment of the present invention. The toe side view of the golf club head 200 allows two key features to be shown in more detail. More specifically, FIG. 2 of the accompanying drawings shows a leading edge 220, which is defined in the current application as the most forward point of the golf club head 220, with the hosel 210 in an upright 90 degree position from a ground plane 224. This leading edge 220 is then defined as the forward most point along the z-axis, as indicated by the axis of origin 201. In addition to illustrating the leading edge 220, FIG. 2 of the accompanying drawings shows a sole trailing contact point 222, which is defined as the lowest point and most rearward point of the golf club head 200, again with the hosel 210 in a 90 degree position from the ground plane 224. The sole trailing contact point 222 is then defined as the lowest point along a y-axis, referring back to the origin 201. The sole trailing contact point 222 may be used to create cross-sectional line A-A', which will be used to create different cross-sectional views of the golf club head 200 in subsequent figures to illustrate the innovative sole profile. Using the leading edge 220 and the sole contact point 222, the sole width d1 of the golf club head 220 can be defined. The sole width d1, of a golf club head 200 in accordance with the current embodiment may vary depending on the loft and bounce of the golf club head 200, but may generally be between about 5 mm to about 22 mm, more preferably between about 10 mm to about 22 mm, and most preferably between about 15 mm to about 22 mm without departing from the scope and content of the present invention.

It should be noted here that in this current exemplary embodiment of the present invention, the leading edge 220 occurs at a specific point along the x-y-plane and the sole trailing contact point 222 is generally defined along the x-axis. This leading edge 220 along the x-axis, may generally occur at the "center of the golf club head 200", which is defined as the center point of the scorelines instead of the actual geometric center of the golf club head 200 along the x-axis. In order to better illustrate the definition of the "center of the golf club head 200" used in the current disclosure, FIG. 3 is provided showing a golf club head 300 from a frontal view.

Figure 3:
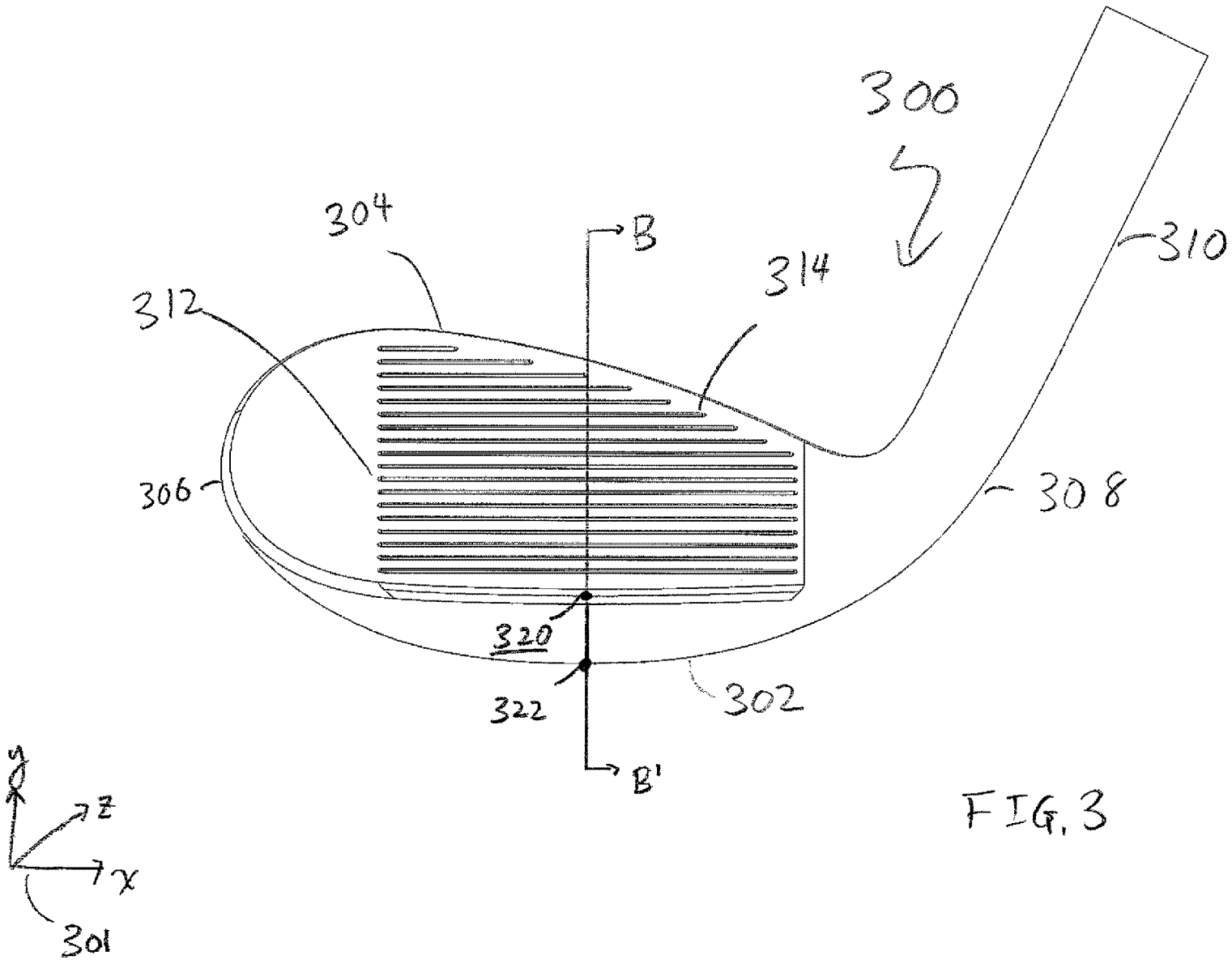
FIG. 3 of the accompanying drawings shows a frontal view of a golf club head in accordance with an exemplary embodiment of the present invention.

FIG. 3 of the accompanying drawings shows a frontal view of a golf club head 300 in accordance with an exemplary embodiment of the present invention. In the frontal view of the golf club head 300 shown in FIG. 3, previously mentioned golf club head 300 components such as the sole 302, topline 304, toe portion 306, heel portion 308, and the hosel 310 still remain. In addition to the previously mentioned components, FIG. 3 shows the striking face 312 located at a frontal portion of the golf club head 300 adapted for striking a golf ball. The striking face 312 may further be comprised out of a plurality of scorelines 314, which helps control the spin of a golf ball that comes in contact with the striking face 312 of the golf club head 300. The scorelines 314 shown in FIG. 3, may serve to help define "center of the golf club head 300" for the current application. More specifically, "center of the golf club head 300", as defined by the current disclosure, refers to the center point of the lowest scoreline 314 along the x-axis shown by origin 301. The location of the "center of the golf club head 300" along the x-axis can then serve to help define cross-sectional line B-B', which includes leading edge 320 and sole trailing contact point 322. Further detail can be shown regarding the innovative sole 302 profile in accordance with the present invention can be shown in FIG. 4, which provides a cross-sectional view of the golf club head 300 taken along cross-sectional line B-B'.

Figure 4:
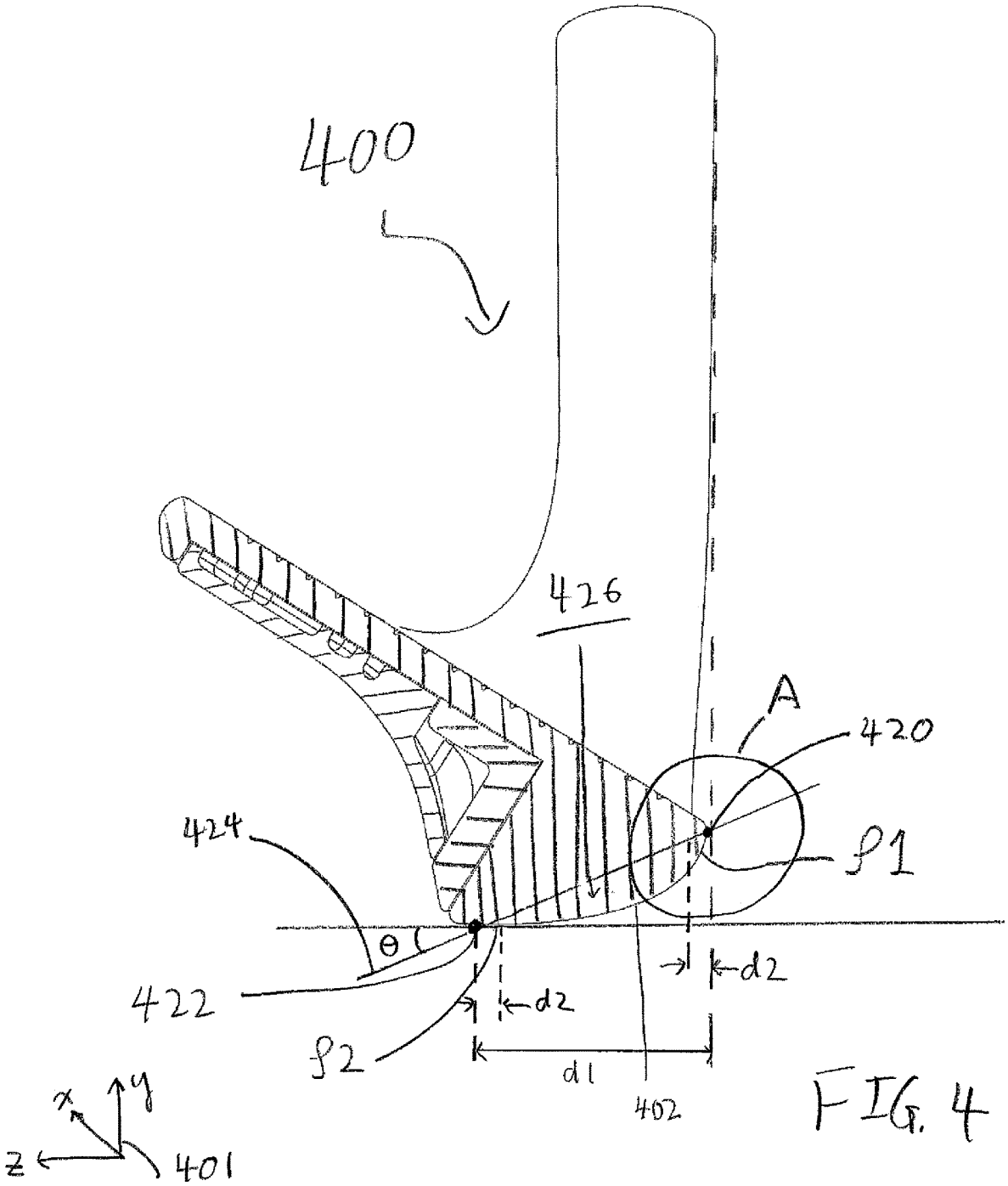
FIG. 4 of the accompanying drawings shows a cross-sectional view of a golf club head in accordance with an exemplary embodiment of the present invention taken along cross-sectional line B-B' shown in FIG. 3.

FIG. 4 of the accompanying drawings shows a cross-sectional view of a golf club head 400 taken along cross-sectional line B-B' shown in FIG. 3. This cross-sectional view of the golf club head 400 allows a better illustration of the innovative sole 402 in accordance with the present invention. First and foremost, it is worth noting here that FIG. 4 of the accompanying drawings is based off an embodiment of the golf club head 400 that has a high bounce sole 402 profile. High bounce sole 402 may generally have a higher bounce angle θ, defined as the angle created between the leading edge point 420 and the sole trailing contact point 422. The bounce angle θ in this embodiment of the present invention may generally be greater than about 20°. In addition to showing the bounce angle, FIG. 4 of the accompanying drawings also shows a sole width d1 of the current golf club head 400 as being between about 15 mm and about 22 mm, more preferably between about 10 mm and about 22 mm, and most preferably between about 15 mm and about 22 mm. The sole width d1 in this embodiment is defined as the distance along the z-axis measured from the leading edge point 420 and the sole trailing contact point 422.

In addition to illustrating the bounce angle θ of the golf club head 400, FIG. 4 of the accompanying drawing also shows a leading edge sole radius ρ1 located near the leading edge point 420 as well training edge sole radius ρ2 located at the sole trailing contact point 422. The leading edge sole radius ρ1 in this invention may generally be defined at the radius of curvature of the sole 402 for an initial distance of d2 of exactly 1.2 mm rearward of the leading edge point 420, while the trailing edge sole radius ρ2 may generally be defined as the radius of the curvature of the sole 402 for a terminal distance d2 of exactly 1.2 mm forward of the sole trailing contact point 422. Unlike some prior art golf clubs that creates a sole using a convex sole followed by a concave sole, the present invention utilizes a continuous convex sole geometry from the leading edge point 420 until the sole trailing contact point 422. Alternatively speaking, it can be said that both the leading edge sole radius ρ1 and the trailing edge sole radius ρ2 are both convex in shape. The continuously variable sole 402 in this embodiment of the present invention may generally begin with a leading edge sole radius ρ1 of less than about 10 mm and finish with a trailing edge sole radius ρ2 of greater than about 40 mm, more preferably begin with a leading edge sole radius ρ1 of less than about 9 mm and finish with a trailing edge sole radius ρ2 of greater than about 41 mm, and most preferably begin with a leading edge sole radius ρ1 of less than about 8 mm and finish with a trailing edge sole radius ρ2 of greater than about 42 mm.

Due to the dramatic difference between the leading edge sole radius ρ1 and the trailing edge sole radius ρ2, it can be said that a golf club head 400 in accordance with the present invention may have a rounder sole profile near the leading edge point 420, while at the same time having a flatter sole profile near the sole trailing contact point 422. Alternatively speaking, the golf club head 400 in accordance with an exemplary embodiment of the present invention may generally have a "Sole Contour Ratio" of less than about 0.25, more preferably less than about 0.21, and most preferably less than about 0.19. The "Sole Contour Ratio" is defined by Equation (1) below:

$$\text{"Sole Contour Ratio"} = \frac{\text{Leading Edge Sole Radius } \rho 1}{\text{Trailing Edge Sole Radius } \rho 2} \qquad \text{Eq. (1)}$$

FIG. 4 of the accompanying drawings also illustrates another characteristic of the current innovative sole 402 of having a large amount of area contained below the bounce bifurcation line 424, especially when compared to a traditional wedge type golf club head. The bounce bifurcation line 424, as shown in this current embodiment of the present invention, as shown here in FIG. 4 is defined as the line that connects the leading edge point 420 and the sole trailing contact point 422, and helps create the sole camber area 426. Because the area below the sole bifurcation line 424 becomes larger as the bounce angle θ of the sole 402 increase, in the current high bounce version of the golf club head 400, the sole camber area 426 may generally be greater than about 42 $mm^2$, more preferably greater than about 45 $mm^2$, and most preferably greater than about 48 $mm^2$.

Due to the fact that the sole camber area 426 is a function of the bounce angle θ, another interesting relationship could be created to quantify the unique sole 402 contour of the current golf club head 400. More specifically, it can be said that a sole 402 profile in accordance with a present invention may have a "Camber to Bounce Area Ratio" of greater than about 2.00 $mm^2/°$, more preferably greater than about 2.50 $mm^2/°$, and most preferably greater than about 3.00 $mm^2/°$ all without departing from the scope and content of the present invention. The "Camber to Bounce Area Ratio", as it can be seen from FIG. 4 is a way to quantify the meatiness of the sole 402 as it relates to a specific bounce angle θ, and can be defined by Equation (2) below:

$$\text{"Camber to Bounce Area Ratio"} = \frac{\text{Sole Camber Area 426}}{\text{Bounce Angle } \theta} \qquad \text{Eq. (2)}$$

Figure 5:
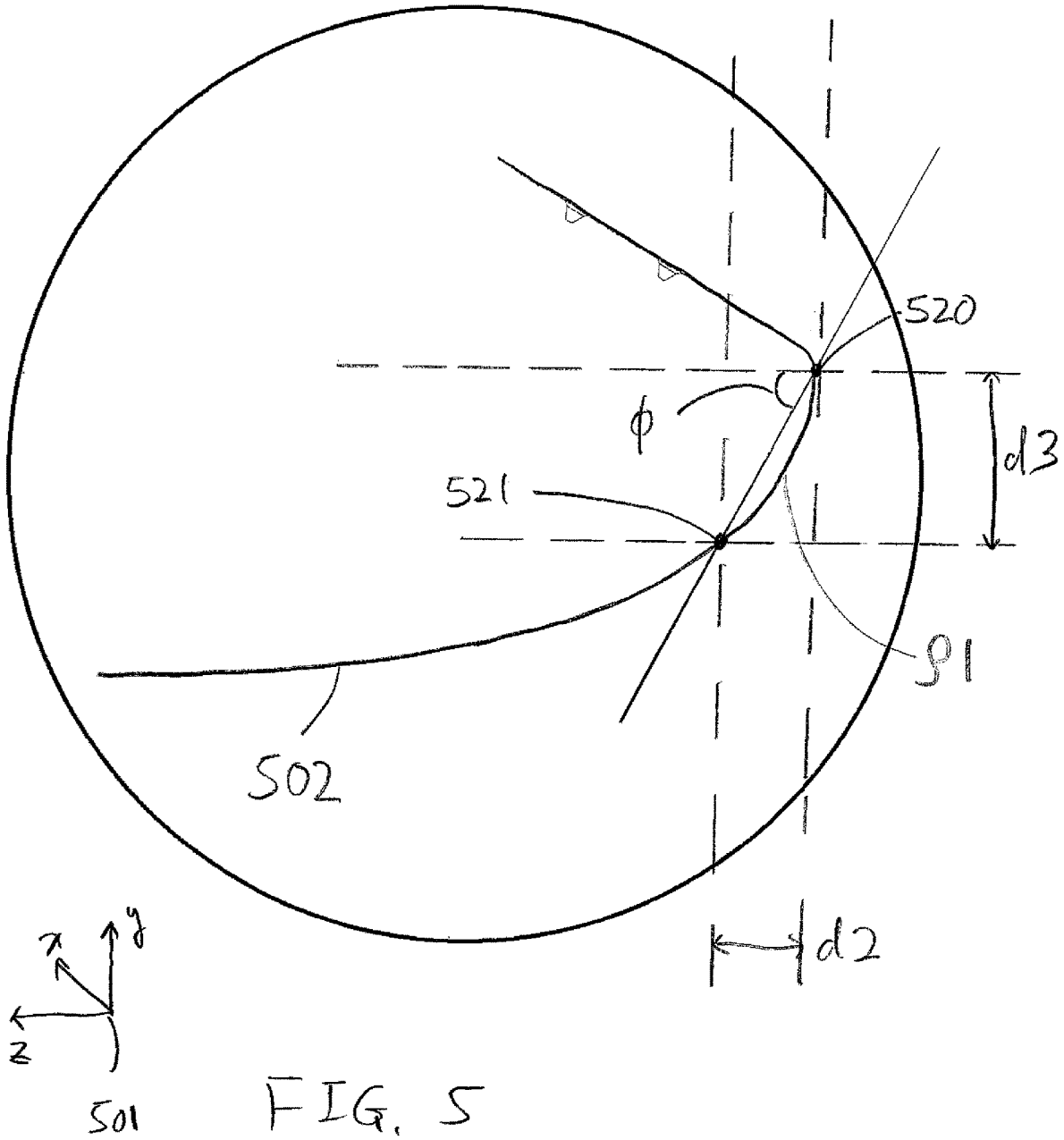
FIG. 5 of the accompanying drawings shows an enlarged cross-sectional view of a leading edge portion of a golf club head, as identified by circular region A shown in FIG. 4.

Finally, FIG. 4 of the accompanying drawings shows a circular region A covering the leading edge point 420 as well as the leading edge sole radius ρ1, allowing more details of that very important portion of the golf club head 400 to be shown in more detail in FIG. 5.

FIG. 5 of the accompanying drawings shows an enlarged cross-sectional view of the leading edge point 520 as well as the leading edge sole radius ρ1 shown as circular region A in FIG. 4. This enlarged view of the golf club head allows the focus of the discussion to shift to the leading edge point 520, which is critical to the proper function of the current inventive sole 502 of the present invention. As previous discussion has already addressed, the new innovative continuously variable sole derives its benefit from creating a new innovative sole 502 profile; and the leading edge point 520 helps define the start of this innovative sole 502 profile. In order to quantify this unique innovative sole 502 profile near the leading edge point 520, an offset distance d2 has already been discussed above in FIG. 4 as being exactly 1.2 mm away from the leading edge point 520. This offset distance d2 helps create a leading edge sole profile, beginning with the leading edge point 520 and ending with a leading edge trailing point 521. Although the leading edge sole radius ρ1 has already discussed in prior discussion regarding FIG. 4, the enlarged cross-sectional view shown here allows two additional variables to be illustrated. The two key additional variable shown here is the leading edge sole entry height d3, and the leading edge sole entry angle Φ, both are critical in providing more detail regarding the innovative sole 502 of the golf club head.

The sole entry height d3 shown in FIG. 5 illustrates the amount of sole thickness formed in an initial portion of the sole 502 of the golf club head. This initial portion is defined as d2, which has already been previously defined as a distance of exactly 1.2 mm rearward from the leading edge point 520. In order to determine the sole entry height d3, the height difference between the leading edge point and the sole thickness at the leading edge trailing point 521 along the y-axis identified by origin 501. In this current exemplary embodiment of the present invention, the sole entry height d3 may generally be between about 2.0 mm and about 8.0 mm, more preferably between about 2.5 mm and about 8.0 mm, and most preferably between about 3.0 mm and about 8.0 mm. Alternatively speaking, it can be said that the sole entry height d3 is defined as a difference between a height of the sole 502 at said leading edge point 520 and a height of said sole at a distance d2 of 1.2 mm back from the leading edge point 520. In order to create this inventive sole profile, the sole entry height d3 may generally be paired with a sole entry angle Φ of greater than about 60°, more preferably greater than about 65°, and most preferably greater than about 67.5°. This sole entry angle Φ may generally be defined as the angle created by the line created by the leading edge point 520 and the leading edge trailing point 521, relative to a horizontal plane.

Figure 6:
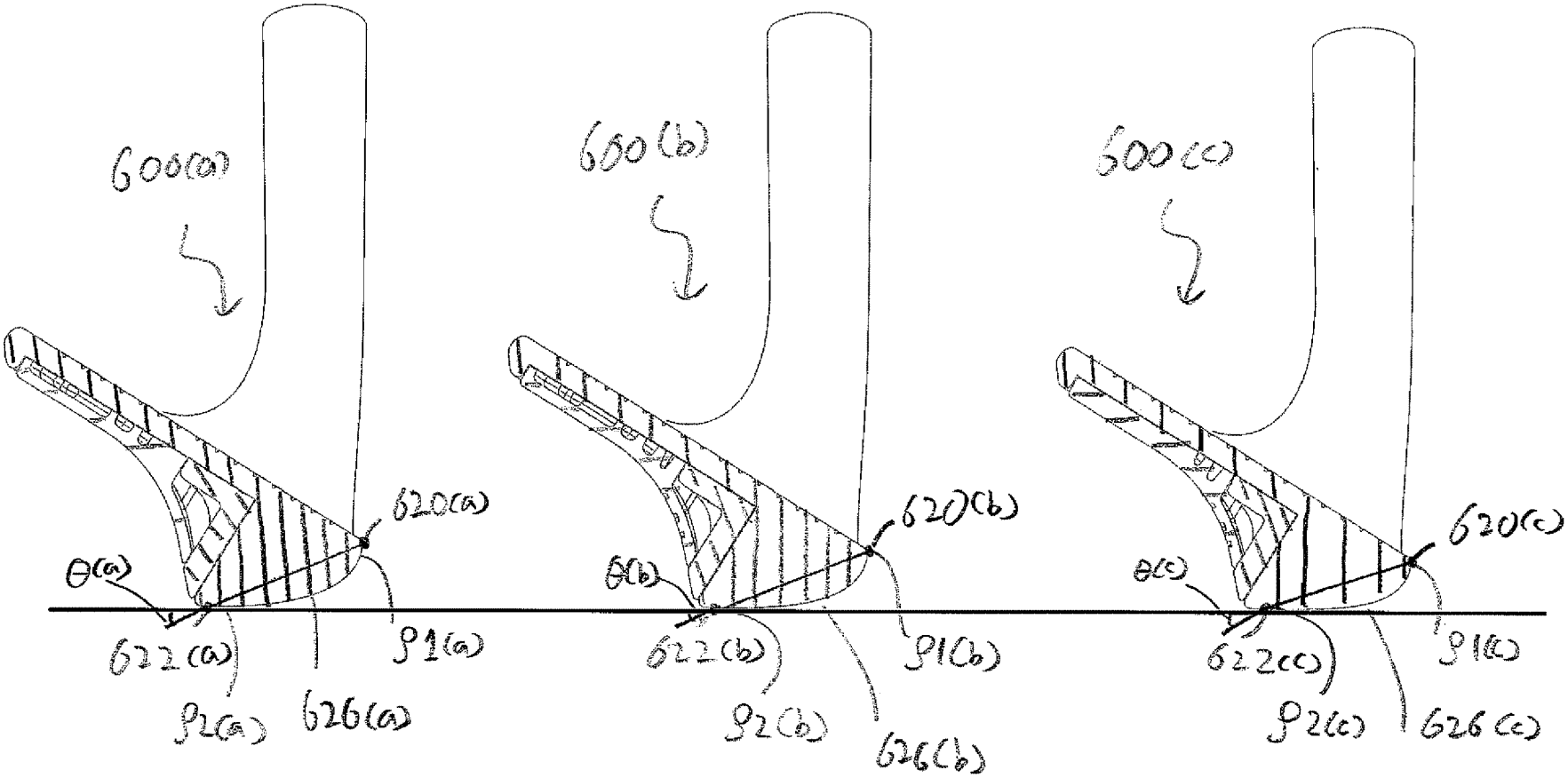
FIG. 6 of the accompanying drawings shows three cross-sectional views of three different golf club heads in accordance with different embodiments of the present invention, each having a different bounce angle, all taken along cross-sectional line B-B' shown in FIG. 3.

FIG. 6 of the accompanying drawings shows a cross-sectional views of different golf club heads 600(*a*), 600(*b*), and 600(*c*) in accordance with different embodiments of the present invention that have a high bounce angle θ(*a*), mid bounce θ(*b*), and low bounce θ(*c*) soles respectively. Visually, it can be seen from the combined view of the three cross-sectional views here that different bounce angles may yield different leading edge point 620(*a*), 620(*b*), and 620(*c*) that correspond with different sole trailing contact points 622(*a*), 622(*b*), and 622(*c*) respectively. Needless to say, the different bounce angles will yield different leading edge sole radius ρ1(*a*), ρ1(*b*), and ρ1(*c*) as well as different trailing edge sole radius ρ2(*a*), ρ2(*b*), and ρ2(*c*). Although the discussion above providing the range of data is applicable irrespective of the bounce angle θ, specific numbers will be provided below in Table 1, illustrating the trend of the changes in these key features in their specific embodiments.

Figure 7:
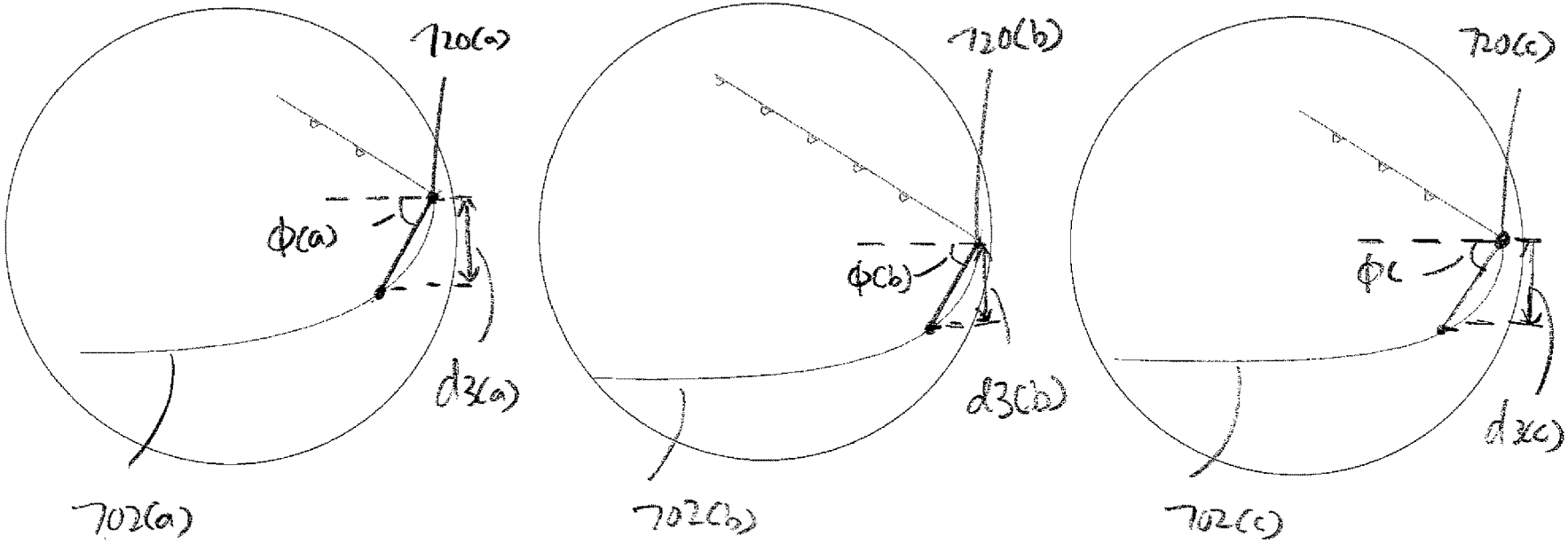
FIG. 7 of the accompanying drawings shows three enlarged cross-sectional views of leading edge portions of golf club heads in accordance with different embodiments of the present invention, each having a different bounce angle, all pursuant to the circular region A identified in FIG. 4.

Before moving onto Table 1, FIG. 7 of the accompanying drawings that provide enlarged views of the leading edge portion of the sole of golf club heads in accordance with different embodiments of the present invention having different bounce angles. More specifically, FIG. 7 shows sole entry angle Φ(*a*), Φ(b), and Φ(*c*) pairing with a high bounce, mid bounce, and a low bounce sole respectively. Finally, FIG. 7 also shows leading edge sole entry height d3(*a*), d3(*b*), and d3(*c*), also pairing with high bounce, mid bounce, and low bounce soles respectively.

TABLE 1

| | High-Bounce | Mid-Bounce | Low-Bounce |
|---|---|---|---|
| Bounce Angle θ | 20.78° | 18.42° | 15.99° |
| Sole Width d1 | 21.87 mm | 21.87 mm | 21.87 mm |
| Leading edge sole radius ρ1 | 5.35 mm | 4.85 mm | 4.65 mm |
| Trailing edge sole radius ρ2 | 61.35 mm | 67.55 mm | 73.75 mm |
| Sole Camber Area 426 | 68.80 $mm^2$ | 59.03 $mm^2$ | 55.32 $mm^2$ |
| Leading edge sole entry angle Φ | 69.61° | 69.15° | 68.67° |
| Leading edge sole entry height d3 | 3.23 mm | 3.15 mm | 3.08 mm |

In addition to providing an innovative sole profile in a front to back orientation that is continuously variable, the innovative sole is also continuously variable in a heel to toe orientation. In order to illustrate this continuously variable sole profile in a heel to toe orientation, FIG. 8 of the accompanying drawings provides a cross-sectional view of a golf club head 800 taken along cross-sectional line A-A' shown in FIG. 2.

Figure 8:
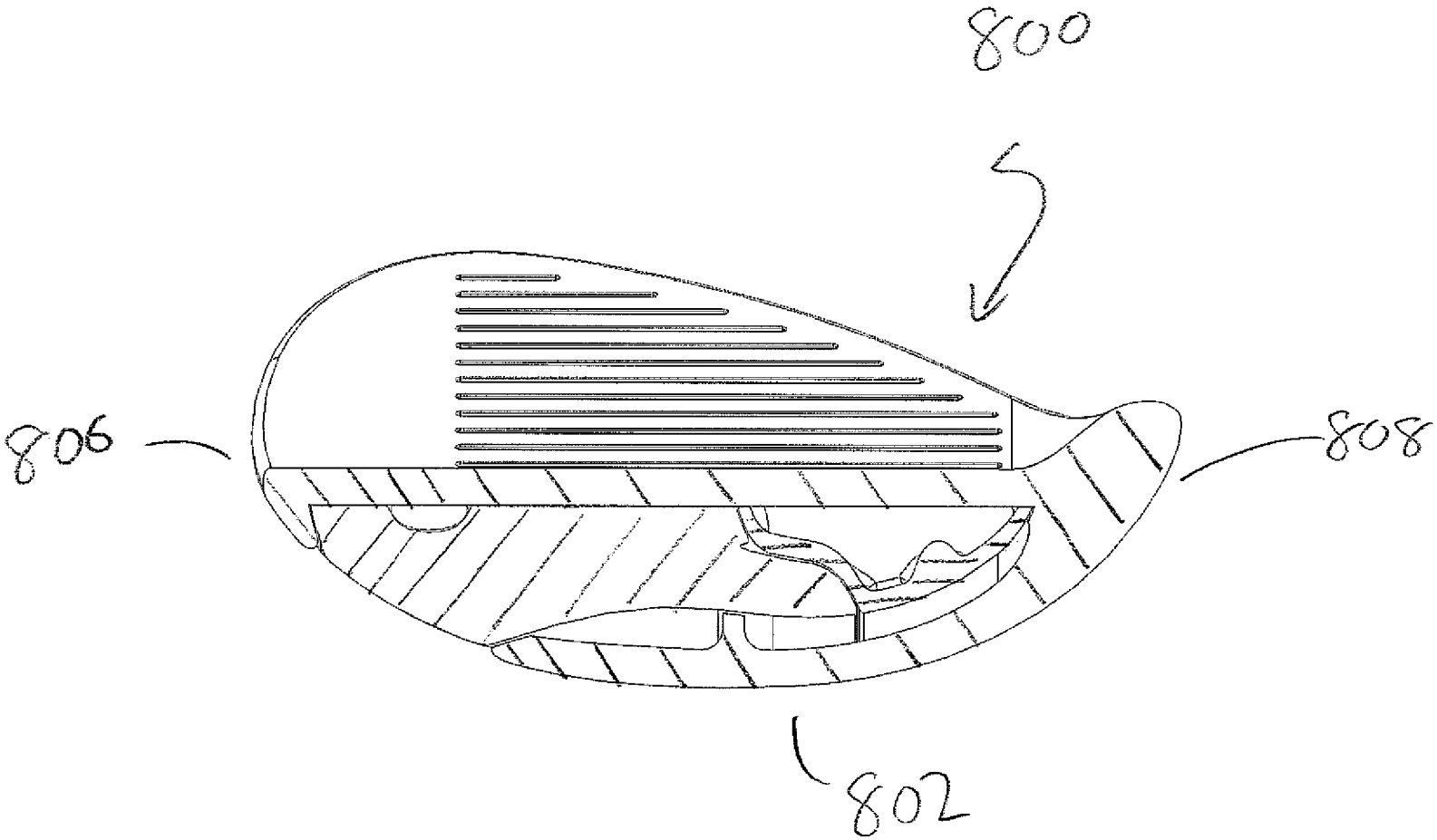
FIG. 8 of the accompanying drawings shows a cross-sectional view of a golf club head in accordance with an alternative embodiment of the present invention, taken long cross-sectional line A-A' identified in FIG. 2.

FIG. 8 of the accompanying drawings shows a cross-sectional view of a golf club head 800 taken along cross-sectional line A-A' shown in FIG. 2 allowing the continuously variable sole profile of the golf club head 800 to be shown more clearly. In this cross-sectional view, it can be seen that the radius of curvature of the sole 802 not only various continuously in a front to back context, but is also continuously variable in the heel 808 to toe 806 direction. In this cross-sectional view, it can be seen that the radius of curvature at the heel 808 and toe 806 ends of the golf club head 800 is dramatically lower than it is at the center of the sole 802, meaning the heel 808 and toe 806 ends are more curved. More specifically, it can be said that in this current embodiment of the present invention, the toe 806 portion of the sole 802 may have a radius of curvature less than about 40 mm, the heel portion 808 of the sole may have a radius of curvature of less than about 30 mm; all while the center portion of the sole 802 may have a radius of curvature of greater than about 70 mm.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head, a topline located at an upper portion of said golf club head, a heel portion located at a proximal end of said golf club head, adapted to receive a shaft, a toe portion located at a distal end of said golf club head opposite said heel end, and a sole, located at a lower portion of said golf club head opposite said topline, further comprising a leading edge point and a sole trailing contact point;

wherein said sole is continuously convex from said leading edge point to said sole trailing contact point;

wherein said golf club head has a "Camber to Bounce Area Ratio" of greater than about 3.0 $mm^2/°$;

said "Camber to Bounce Area Ratio" is defined as a cross-sectional sole camber area of said golf club head divided by a cross-sectional bounce angle of said golf club head.

2. The golf club head of claim 1, wherein said sole has a sole entry angle of greater than about 60°;

said sole entry angle defined as an angle created by a line connecting said leading edge point and a height of said sole at a distance 1.2 mm back from said leading edge point, relative to a horizontal plane.

3. The golf club head of claim 2, wherein said sole has a sole entry angle of greater than about 65°.

4. The golf club head of claim 3, wherein said sole entry angle is greater than about 67.5°.

5. The golf club head of claim 1, wherein said golf club head has a "Sole Contour Ratio" of less than about 0.25;

said "Sole Contour Ratio" is defined as a leading edge sole radius divided by a trailing edge sole radius.

6. The golf club head of claim 5, wherein said "Sole Contour Ratio" of said sole is less than about 0.21.

7. The golf club head of claim 6, wherein said "Sole Contour Ratio" of said sole is less than about 0.19.

8. The golf club head of claim 7, wherein said leading edge sole radius is less than about 10 mm.

9. The golf club head of claim 8, wherein said leading edge sole radius is less than about 9 mm.

10. The golf club head of claim 9, wherein said trailing edge sole radius is greater than about 40 mm.

11. The golf club head of claim 10, wherein said trailing edge sole radius is greater than about 41 mm.

12. The golf club head of claim 11, wherein said trailing edge sole radius is greater than about 42 mm.

* * * * *